US007158023B2

(12) United States Patent
Kaiser

(10) Patent No.: US 7,158,023 B2
(45) Date of Patent: Jan. 2, 2007

(54) METHOD FOR TESTING THE INTERCONNECTION OF REMOTE HAZARDOUS CONDITION DETECTORS

(75) Inventor: Timothy D. Kaiser, Plain City, OH (US)

(73) Assignee: Ranco Incorporated of Delaware, Wilmington, DE (US)

( * ) Notice: Subject to any disclaimer, the term of this patent is extended or adjusted under 35 U.S.C. 154(b) by 110 days.

(21) Appl. No.: 10/967,645

(22) Filed: Oct. 15, 2004

(65) Prior Publication Data

US 2006/0082453 A1 Apr. 20, 2006

(51) Int. Cl.
*G08B 29/00* (2006.01)

(52) U.S. Cl. ..... 340/514; 340/506

(58) Field of Classification Search ..... 340/514, 340/508, 505, 506, 693.6, 628
See application file for complete search history.

(56) References Cited

U.S. PATENT DOCUMENTS 5,202,673 A * 4/1993 Conrad ..... 340/524
5,705,979 A * 1/1998 Fierro et al. ..... 340/517
6,611,204 B1 8/2003 Schmurr
6,624,750 B1 * 9/2003 Marman et al. ..... 340/506
6,950,016 B1 * 9/2005 Farley ..... 340/514

* cited by examiner

*Primary Examiner*—John Tweel, Jr.
(74) *Attorney, Agent, or Firm*—Reinhart Boerner Van Deuren P.C.

(57) ABSTRACT

A method of testing the interconnect between remotely distributed hazardous condition detectors is provided. The method utilizes the detector's self-test button to initiate a detector self-test. Once the self-test is complete, the detector's alarm is silenced and an interconnect test signal is sent to the interconnected remote hazardous condition detectors. The transmission of this signal continues so long as the test button remains depressed. The remote detectors, on receipt of this signal, sound their alarm. The user, with the local detector's alarm now silenced, is better able to hear the remotely interconnected detector's alarm.

20 Claims, 4 Drawing Sheets

METHOD FOR TESTING THE INTERCONNECTION OF REMOTE HAZARDOUS CONDITION DETECTORS

FIELD OF THE INVENTION

This invention relates generally to interconnected hazardous condition detectors, and more particularly to test methods for use therewith.

BACKGROUND OF THE INVENTION

As the life-saving benefits of hazardous condition detectors are recognized, their usage continues to expand. Such hazardous condition detectors include smoke detectors, carbon monoxide detectors, flammable vapor detectors, combination units, etc. Indeed, the installation of such detectors is mandated in many states by building code for all new construction of single and multi-family dwellings, office buildings, schools, etc. Further, many areas also require that such detectors be installed in existing homes before they may be sold.

Because many such structures include multiple floors, rooms, or areas on or in which a remotely located hazardous condition detector may not be heard, it is recommended that multiple hazardous condition detectors be located throughout the structure or dwelling to increase the likelihood of early detection of a hazardous condition. Such early detection is a direct factor in the survivability of the occupants within the dwelling or structure.

In a typical single family dwelling having a basement and two stories, at least one hazardous condition detector should be placed on each floor of the dwelling. That is, at least one detector should be placed in the basement, on the first floor, and on the second floor. In this way, a hazardous condition that originates in the basement may be detected sooner than if the only hazardous detector were located on the second floor. Indeed, even in single floor plan dwellings or structures, it is recommended to include multiple detectors at various locations. For example, a hazardous condition detector may be located in the utility room housing the furnace, water heater, etc., one in the kitchen and one in each of the bedrooms or in the hallway by the bedrooms. Regardless of the configuration, however, the use of multiple, hazardous condition detectors provides the advantage of detecting the hazardous condition early to allow the occupants as much time as possible to avoid danger.

While the use of multiple hazardous condition detectors at different locations throughout a dwelling or structure increases the likelihood of detecting a hazardous condition early, the layout of the dwelling or structure may well prevent an occupant from hearing the alarm of the hazardous condition detector located in proximity to the hazardous condition when it sounds. For example, if the hazardous condition detector in the basement of a two-story single family dwelling were to detect a hazardous condition and sound its alarm, the occupants who may be asleep on the second story may not be able to hear the alarm sounding in the basement. Indeed, many dwellings are constructed with insulation between the stories for the very purpose of stopping the transmission of noise therebetween. However, such sound insulation may well detract from the advantage of installing multiple hazardous condition detectors throughout the dwelling. If the hazardous condition continues to expand, the other detectors in the dwelling or structure will eventually detect this hazardous condition and hopefully alert the occupant of the existence of such a condition in time for the occupant to escape the danger.

To overcome this problem, the hazardous condition detectors may be interconnected or networked together utilizing a wired connection or wireless transmission. In some installations the hazardous condition detectors report to a central control module which may then command the other hazardous condition detectors to sound their alarms throughout the dwelling. In other embodiments, the hazardous condition detectors communicate among themselves without requiring a central control module. In such an installation the detecting hazardous condition detector sounds its alarm and transmits a hazardous condition detected signal to the other interconnected hazardous condition detectors. These detectors then sound their alarm to notify the occupant of the detected hazardous condition within the dwelling.

Circuitry within the detectors ensures that only an alarm for the detected hazardous condition be sounded. That is, it is common for many dwellings or structures to include multiples types of hazardous condition detectors, each having a distinctive alarm pattern to alert the user to the different types of detected hazardous conditions. For example, a typical single family dwelling may include both smoke and carbon monoxide detectors. In such an installation, the detection of smoke will result in only smoke alarms being sounded throughout the dwelling. That is, no carbon monoxide alarm signal will be sounded by a carbon monoxide detector because smoke is detected by one of the other hazardous condition detectors. The converse is also true. As a result, only the hazardous condition detectors that are capable of sounding the alarm corresponding to the detected hazardous condition will sound such an alarm. The other hazardous condition detectors that are not capable of sounding an alarm that corresponds to the detected hazardous condition will remain silent. One such system of providing communication between hazardous condition detectors is provided in U.S. Pat. No. 6,611,204, entitled "Hazard Alarm, System, and Communication Therefore", the teachings and disclosure of which are hereby incorporated in their entireties by reference thereto. However, other systems of communication and interconnection between hazardous condition detectors may also be used.

Since hazardous condition detectors are typically silent due to the absence of a hazardous condition, it is recommended that the user periodically test the functionality of the hazardous condition detector to ensure its continued operation. Typically, each hazardous condition detector includes a self-test button that may be depressed by the user to initiate a detector self-test. To initiate the test, the user depresses and holds the button while the detector performs its internal self-test. If the user releases the button prior to the completion of the self-test, the detector will typically abort the self-test. However, if the user continues to depress the test button, the detector will run its internal self-test, typically resulting in the sounding of the hazardous condition detector alarm. Once the alarm has sounded the user knows that the hazardous condition detector is functioning properly and may release the button. However, even if such a test is performed on each individual detector, the user cannot be assured that they will all sound if one of them detects a hazard because these individual tests do not test their interconnection.

While such a test may be completed by the user in less than a minute, the requirement that the user test each and every one of the distributed hazardous condition detectors within the dwelling or structure becomes quite time consuming. Further, since the test button is typically located on the actual detector itself, and since most detectors are mounted on the ceiling, the user also typically needs to utilize a step ladder to reach the detector test button. This effort combined with the time for each individual test, while minimal in comparison to the safety features provided, often results in the user not conducting the recommended functionality tests of the hazardous condition detectors. This may result in a situation where some of the hazardous condition detectors may not be functional without the user being aware of the lack of protection provided thereby.

To overcome this problem, many hazardous condition detectors include the capability to transmit a signal to the other interconnected hazardous condition detectors if the test button remains depressed once the hazardous condition detector has completed its self-test. The interconnected detectors, upon receipt of the signal, will sound their alarms just as if it had received a signal from a hazardous condition detector that had detected a hazardous condition. In this way, the user can be assured that the interconnection between these hazardous condition detectors and/or their ability to communicate have not been compromised.

While this test method is effective to test the integrity of the interconnection between the hazardous condition detectors themselves, the user may be unable to tell if the test is successfully passed or not. This is because the only indication of test success is the sounding of the remote detectors' alarm. However, so long as its self-test button is depressed, the hazardous condition detector will continue to sound its alarm. Since a typical hazardous condition alarm is at least 85 db, the user who is standing close enough to the detector to actually depress its self-test button is unlikely to be able to hear the alarm of the remotely located hazardous condition detectors. This is particularly true when the remotely located hazardous condition detectors are installed on other floors of a multi-story dwelling or in remote locations.

As a result, the current test is wholly ineffective for testing anything other than the particular hazardous condition detector whose self-test button has been depressed. As such, the user is still required to physically go to each hazardous condition detector and perform its own self-test. As indicated above, however, such a requirement will typically result in the system not being tested by the user as recommended due to the time and hassle involved in physically going to each remotely located hazardous condition detector, climbing on the step ladder, and holding the self-test button for a time sufficient to complete that detector's internal self diagnostic test. Even if this were done, however, the user still cannot be assured that the interconnection between the hazardous condition detectors has not been compromised.

In view of the above, there exists the need in the art for a reliable and effective testing mechanism to allow a user to verify the integrity of the interconnection between multiple hazardous condition detectors.

These and other advantages of the invention, as well as additional inventive features, will be apparent from the description of the invention provided herein.

BRIEF SUMMARY OF THE INVENTION

In view of the above, it is an object of the present invention to provide a new and improved remote hazardous condition detector interconnect test method. More particularly, it is an object of the present invention to provide a new and improved remote hazardous condition detector interconnect test method that may be initiated from a single interconnected or networked hazardous condition detector. Further, it is an object of the present invention to provide a new and improved remote hazardous condition detector interconnect test method that allows a user to determine the operational integrity of the interconnect or communications link from the location of the initiating hazardous condition detector.

In one embodiment of the present invention a user may initiate a hazardous condition detector self-test by depressing the test button on the detector. If the user were to continue holding the test button in its depressed position after completion of the hazardous condition detector self diagnostic test, that detector would silence its alarm and transmit an interconnect integrity test signal to the other interconnected hazardous condition detectors. The user would then be able to listen for the other detectors sounding their alarms to determine the operational integrity of the interconnect.

In a preferred embodiment to the present invention, selection of the test button on the hazardous condition detector will initiate the detector's self-test. If this self-test is successful, the hazardous condition detector will sound its horn pattern as dictated by its internal self-test procedure. Once this self-test has been completed, the alarm on the hazardous condition detector will be silenced even if the test button is still depressed. Indeed, if the test button is still depressed once the self-test has been completed, the hazardous condition detector will transmit a remote interconnect test signal to the other interconnected hazardous condition detectors. This transmission will continue so long as the test button remains depressed to allow the user whatever time is required to determine the operational integrity of the interconnection or communications link. Once the test button has been released, the hazardous condition detector will stop transmitting the remote interconnect test signal. In a highly preferred embodiment, the transmission of the remote interconnect test signal will be accomplished even if the detector fails its own internal self-test and never sounds its horn pattern so long as the test button remains depressed once the self-test has been completed.

In this embodiment, the remote hazardous condition detectors will receive the remote interconnect test signal via the interconnect, wirelessly, etc. Once this signal has been received the remote hazardous condition detector will sounds its alarm pattern. This sounding will continue until the remote interconnect test signal has been removed once the user has released the test button of the initiating hazardous condition detector.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

Figure 1:
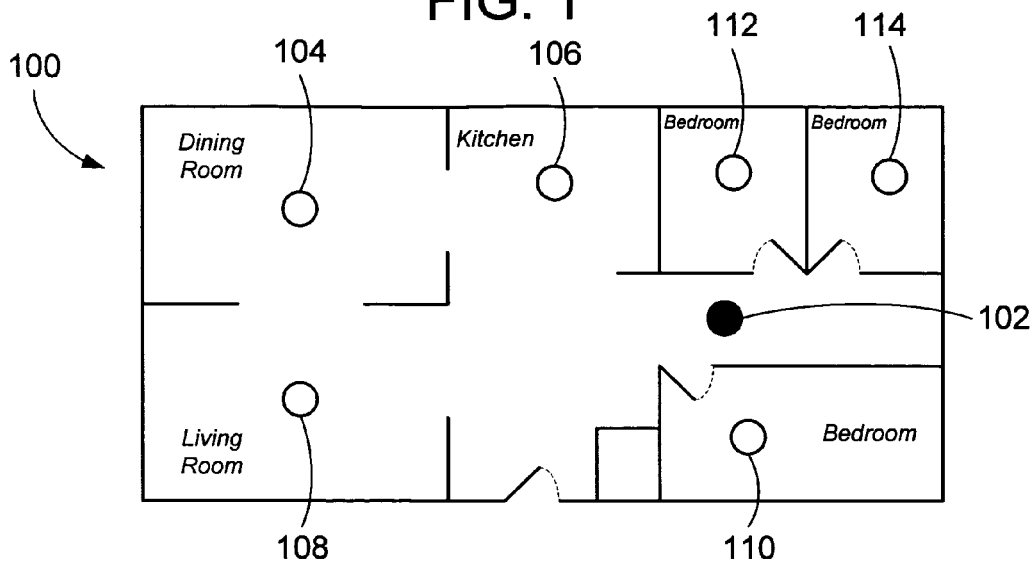
FIG. 1 is an exemplary smoke detector placement diagram for a single floor plan existing home.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Because every additional second of notice that an occupant has of the existence of a hazardous condition increases the occupants' chance of escaping danger, the use of multiple hazardous condition detectors throughout a dwelling or other structure is highly desirable as discussed above. Indeed, complete coverage protection is achieved by installing an appropriate hazardous condition detector in every room of a dwelling. Smoke detectors should be installed in accordance with the National Fire Protection Associations Standard 72 (National Fire Protection Association, Battery March Park, Quincy, Mass. 02269). The NFPA standard identifies the minimum requirement for locating smoke alarms in family living units. It states: "2-2.1.1.1 smoke alarms shall be installed outside of each separate sleeping area in the immediate vicinity of the bedrooms and on each additional story of the family living unit including basements and excluding crawl spaces and unfinished attics. In new construction, a smoke alarm also shall be installed in each sleeping room." Further, Section 2-2.2.1 states that "in new construction, where more than one smoke alarm is required by 2-2.1, they shall be so arranged that operation of any smoke alarm shall cause the alarm in all smoke alarms within the dwelling to sound." The NFPA, 1993 Addition, Appendix A, however, clearly points out that "the required number of smoke alarms (as defined in the paragraphs above) may not provide reliable early warning protection for those areas separated by a door from the areas protected by the required smoke alarms. For this reason, it is recommended that the house holder consider the use of additional smoke alarms for those areas for increased protection. The additional areas include: basement, bedrooms, dining room, furnace room, utility room, and hallways not protected by the required smoke alarms."

Further, the California State Fire Marshal states that the minimum number of required smoke alarms is not enough to give the earliest warning under all conditions. The California State Fire Marshal states that "early warning fire detection is best achieved by the installation of fire detection equipment in all rooms and areas of the household as follows: "a smoke alarm installed in each separate sleeping area (in the vicinity, but outside the bedrooms), and heat and smoke alarms in the living rooms, dining rooms, bedrooms, kitchens, hallways, attics, furnace rooms, closets, utility and storage rooms, basements and attached garages."

It is clear that the earliest warning of a developing fire is best achieved by the installation of smoke alarms in all rooms and areas of the residence. Accordingly, the resident should install smoke alarms in every room of the residence, including basements and finished attics, even though this is not required by the typical code or standard. In addition, it is recommended that the homeowner interconnect all smoke alarms capable of being interconnected. Further, it is also recommended that a minimum of two smoke alarms be installed in every home, no matter how small the home (including efficiency apartments). Such maximum coverage can be achieved by installing smoke alarms in both required and recommended locations as illustrated and described below.

The NFPA requires a smoke alarm on every level and outside each sleeping area in existing construction. An existing household with one level and one sleeping area is required to have one smoke alarm. Such a required smoke alarm in a single story existing home 100 is illustrated by smoke alarm 102 as illustrated in FIG. 1. However, it is recommended that additional smoke detectors 104–114 be located in each of the dining room, kitchen, living room, and each of the three bedrooms, respectively.

Figure 2:
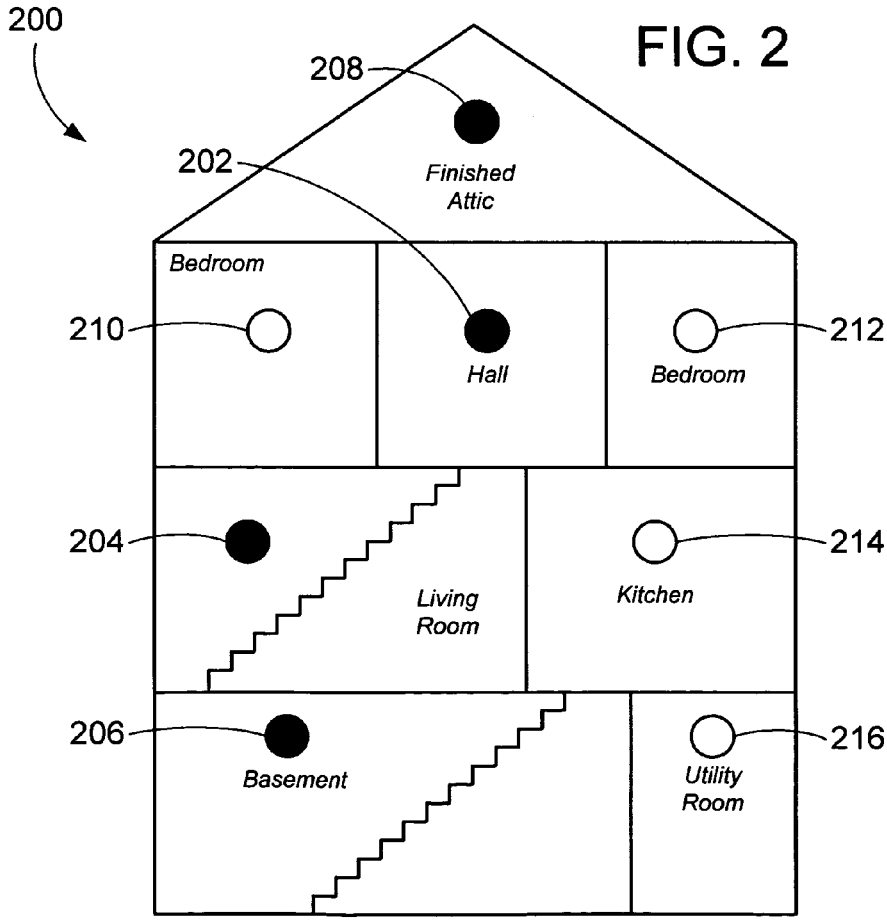
FIG. 2 is an exemplary smoke detector placement diagram for a two-story existing home.

In an existing two-story residence 200, such as that illustrated in FIG. 2, the NFPA requires that a smoke detector 202 be included outside the sleeping area, and detectors 204 and 206 be located on the first floor and in the basement, respectively. Further, the NFPA requires that a smoke detector 208 be included in a finished attic. To provide an added measure of safety, it is recommended that smoke detectors also be included in each of the bedrooms (210, 212), in the kitchen (214), and in the utility room (216).

Figure 3:
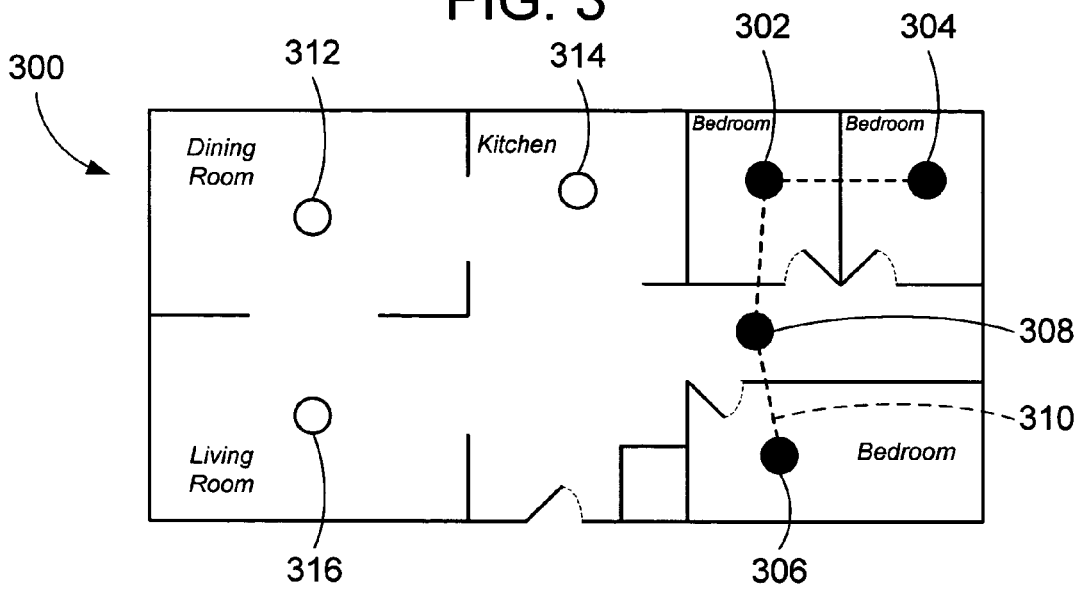
FIG. 3 is an exemplary smoke detector placement diagram for a single floor plan new construction home.

For new construction homes, the NFPA requires AC-powered, interconnected smoke alarms be installed each bedroom, outside each bedroom area, and on every level of the home. The NFPA also requires a minimum of two AC-powered, interconnected smoke alarms in any new construction home regardless of size. FIG. 3 illustrates a single story residence/apartment/mobile home 300 that includes the NFPA required smoke detectors in each of the bedrooms (detectors 302, 304, and 306) and outside the sleeping area (detector 308). As may be seen from this FIG. 3, each of the smoke detectors 302–308 are interconnected (as shown by dashed line 310). In addition to these required smoke detectors, the assignee of the instant application recommends that a smoke detector also be included in the dining room (detector 312), the kitchen (detector 314), and the living room (detector 316).

Figure 4:
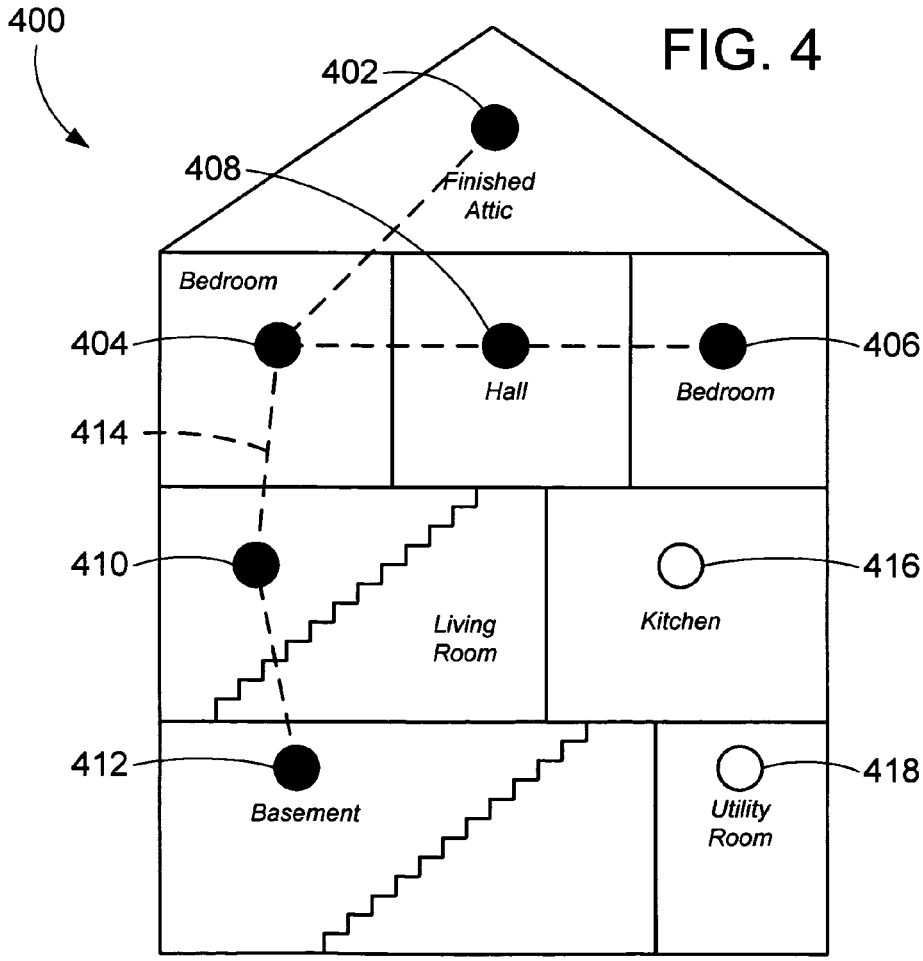
FIG. 4 is an exemplary smoke detector placement diagram for a two-story new construction home.

FIG. 4 illustrates an exemplary two-story new construction home 400 having both NFPA required and additional suggested smoke detectors installed therein. Specifically, the NFPA required smoke detectors include detector 402 in the finished attic, detector 404 and 406 in the bedrooms, detector 408 outside the sleeping area, and detectors 410 and 412 on every level of the two-story residence 400. As may be seen in this FIG. 4, the NFPA also requires that the smoke alarms be interconnected as illustrated by dashed line 414. The additional recommended smoke detectors include detector 416 in the kitchen and 418 in the utility room.

It should be noted that while these additional, recommended smoke detectors are not illustrated as being interconnected with the NFPA required smoke detectors, preferably such an interconnection is provided. As will be recognized by those skilled in the art, such an interconnection can be provided in a number of ways. Such interconnection methods may include a three-wire interconnect, a system bus, wireless communications, etc.

Figure 5:
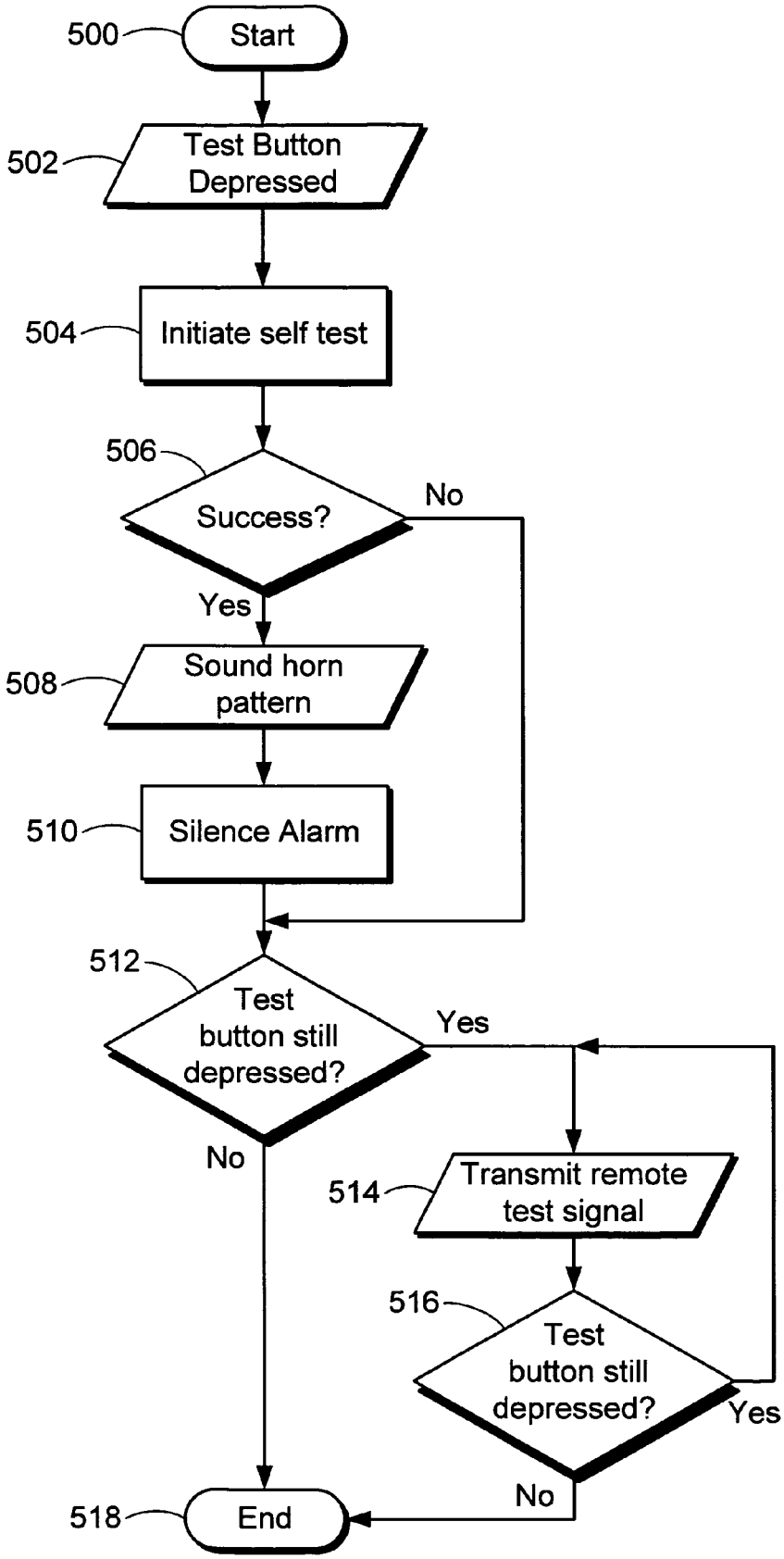
FIG. 5 is a flow diagram illustrating an embodiment of the method of the present invention.

Having described some exemplary installations of one type of hazardous condition detector in both existing and new construction homes, attention is now directed to the flow diagram of FIG. 5. This FIG. 5 illustrates an exemplary embodiment of a method of performing a self-test on a hazardous condition detector and a test of the operational integrity of the interconnect between distributed hazardous condition detectors. Such a test increases the ability of the user to determine if the interconnected detectors are sounding their alarms. Specifically, the method the present invention is initiated 500 when the test button is depressed at step 502 by a user wishing to initiate a hazardous condition detector self-test. However, it should be noted that other methods of initiating the self-test may also be employed depending on the particular hazardous condition detector at which the user is located. The hazardous condition detector thereafter initiates its internal self-test at step 504. The particular tests performed during this self-test may vary, are beyond the scope of the instant invention, and therefore will not be discussed in detail herein. However, those skilled in the art are familiar with such self-tests performed on the functionality of the hazardous condition detectors.

If the self-test is successful 506 the detector will sound its appropriate horn pattern or patterns at step 508. Thereafter the hazardous condition detector will silence its alarm at step 510. This is a significant departure from prior self-test systems that continue to sound the alarm so long as the self-test button is depressed. The advantage of such silencing is that the user will not be subjected to the very loud alarm during the entire period that the self-test button is depressed. Not only will this lessen the discomfort of the user, but it will, as will be described more fully below, also allow the user to listen for the other interconnected hazardous condition detectors to determine the operational status of the interconnect.

Once the alarm has been silenced at step 510, the method of the present invention will check to see if the test button is still depressed by the user at step 512. If the user is still depressing the self-test button, the detector will transmit a remote interconnect test signal at step 514. Preferably, the transmission of this remote interconnect test signal will be continued so long as the self-test button remains depressed as illustrated by decision block 516. However, the detector will cease transmission of the remote interconnect test signal and end the method 518 once the test button is released. This will allow the user the ability to control the duration of the period during which the remote interconnect test signal is transmitted to give the user ample time to discern whether the other interconnected hazardous condition detectors are sounding their alarms. However, once the self-test button has been released, the transmission of this test signal will be halted and the interconnected hazardous condition detectors will silence their alarms.

Figure 6:
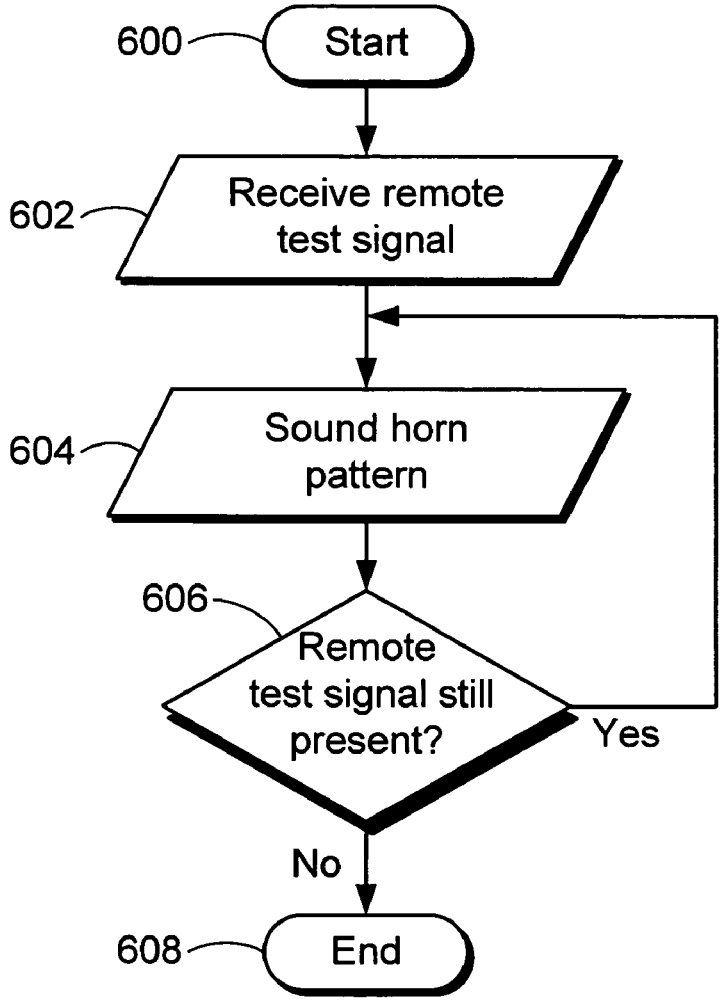
FIG. 6 is a flow diagram illustrating operation of a remote hazardous condition detector upon initiation of the interconnect test method of the present invention.

More particularly, as illustrated in FIG. 6, once the process at the remote interconnected hazardous condition detector has begun 600, the remote interconnect test signal is received 602 via the interconnect. This remote hazardous condition detector will then begin sounding its horn pattern 604 until the remote interconnect test signal is removed as illustrated by decision block 606, at which point the process in this remote hazardous condition detector will end 608.

While the embodiment of the method described above requires the test button to be continuously depressed, another embodiment of the present invention operates to initiate the detector self-test and transmission of the interconnect test signal upon initial selection of the test button, without requiring the user to continuously hold the test button in a depressed position. That is, once the user has selected the test button, the self-test and interconnect test will run automatically without further user intervention required. Preferably, this embodiment of the present invention will allow the user to terminate the self-test and the interconnect test by selecting the self-test button a second time.

In prior systems, it was difficult if not impossible to discern whether the remotely located, interconnected hazardous condition detectors were sounding their alarm or not because the hazardous condition detector which the user was depressing the self-test button continued to sound its very loud alarm. As a result of the near inability to discern the operational status of the interconnect along with the extreme discomfort resulting from extended exposure in close proximity to the alarming detector, many users simply would not attempt to perform this test. As a result, a user would be uninformed of a failure of the interconnect which is required by the NFPA. In such a situation, precious moments may be lost before the occupant is alerted to the hazardous condition that may have originally been detected several minutes earlier in a remote location. Such a situation is unacceptable. The method of the present invention, however, provides an effective method of testing the interconnect between the distributed hazardous condition detectors in a manner that lessens the discomfort of the user, and therefore encourages continued testing throughout the lifetime of the system.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method for testing operational integrity of an interconnection between hazardous condition detectors, comprising the steps of:

receiving a user input to initiate a detector self test;

conducting the detector self test;

sounding an alarm pattern upon success of the self test;

silencing the alarm pattern; and transmitting a remote interconnect test signal.

2. The method of claim 1, further comprising the step of confirming continued receipt of the user input, and wherein the step of transmitting the remote interconnect test signal is accomplished only after the step of confirming continued receipt of the user input.

3. The method of claim 2, wherein the step of transmitting the remote interconnect test signal continues so long as the step of confirming continued receipt of the user input is true.

4. The method of claim 1, wherein the step of transmitting the remote interconnect test signal is performed after the step of silencing the alarm pattern.

5. The method of claim 4, wherein the step of transmitting the remote interconnect test signal is accomplished only if the step of receiving a user input to initiate the detector self test is still true after the step of silencing the alarm pattern.

6. The method of claim 1, wherein the step of transmitting the remote interconnect test signal is performed even if the step of sounding the alarm pattern does not occur because of a failure of the self test.

7. The method of claim 6, wherein the step of transmitting the remote interconnect test signal is performed only if the step of receiving the user input is still true after the step of conducting the detector self test is complete.

8. The method of claim 7, wherein the step of transmitting the remote interconnect test signal continues so long as the step of receiving the user input is still true.

9. A method of verifying integrity of a communications link between hazardous condition detectors, comprising the steps of:

silencing an alarm if currently sounding; and transmitting a remote detector test signal to at least one hazardous condition detector.

10. The method of claim 9, further comprising the step of receiving a user input to initiate testing.

11. The method of claim 10, wherein the step of transmitting the remote detector test signal is continued for so long as the step of receiving the user input is true.

12. The method of claim 10, further comprising the step of conducting a detector self test after the step of receiving the user input and before the steps of silencing and transmitting.

13. The method of claim 12, wherein the step of conducting the detector self test includes the step of sounding the alarm.

14. The method of claim 12, wherein the step of transmitting the remote detector test signal is performed only if the step of receiving the user input is true after the step of conducting the detector self test.

15. The method of claim 14, wherein the step of transmitting the remote detector test signal is continued until the step of receiving the user input is false.

16. A method of testing the functionality of a hazardous condition detector, comprising the steps of:

receiving a user input to initiate testing of the detector;

conducting testing of the detector;

sounding the detector alarm when the testing of the detector is successful;

continuing to receive the user input;

silencing the detector alarm if it is sounding to allow a user to hear other detectors;

transmitting a remote test signal to the other detectors.

17. The method of claim 16, wherein the step of transmitting the remote test signal continues so long as the step of continuing to receive the user input is true.

18. The method of claim 16, further comprising the step of aborting the method when the user input is no longer received.

19. The method of claim 16, wherein the step of transmitting the remote test signal is performed after the step of conducting testing of the detector is the step of continuing to receive the user input is true after the step of conducting testing of the detector is complete.

20. The method of claim 16, wherein the step of transmitting the remote test signal is performed regardless of success or failure of the step of conducting testing of the detector when the step of continuing to receive the user input is true.

* * * * *